US009073119B2

(12) United States Patent
Tremblay et al.

(10) Patent No.: US 9,073,119 B2
(45) Date of Patent: Jul. 7, 2015

(54) RECEPTACLE FOR HANDLING MOLTEN METAL, CASTING ASSEMBLY AND MANUFACTURING METHOD

(71) Applicant: Pyrotek Inc., Spokane Valley, WA (US)

(72) Inventors: Sylvain Tremblay, Chicoutimi (CA); Jens Bouchard, St-Honoré de Chicoutimi (CA); Michael Bouchard, Jonquière (CA)

(73) Assignee: Pyrotek Inc., Spokane Valley, WA (US)

( * ) Notice: Subject to any disclaimer, the term of this patent is extended or adjusted under 35 U.S.C. 154(b) by 117 days.

(21) Appl. No.: 13/912,889

(22) Filed: Jun. 7, 2013

(65) Prior Publication Data

US 2013/0334744 A1 Dec. 19, 2013

Related U.S. Application Data

(60) Provisional application No. 61/659,624, filed on Jun. 14, 2012.

(51) Int. Cl.
*B22D 41/015* (2006.01)
*B22D 41/005* (2006.01)

(52) U.S. Cl.
CPC ..... *B22D 41/015* (2013.01); *B22D 41/005* (2013.01)

(58) Field of Classification Search
CPC ..... B22D 41/015; C21B 7/14; F27D 3/145
USPC ..... 266/191, 196
See application file for complete search history.

(56) References Cited

U.S. PATENT DOCUMENTS

| | | | | |
|---|---|---|---|---|
| 4,508,323 | A * | 4/1985 | Fleming | 266/191 |
| 2010/0109210 | A1 | 5/2010 | Vincent | |
| 2011/0140318 | A1 * | 6/2011 | Reeves et al. | 266/215 |

FOREIGN PATENT DOCUMENTS

| | | | |
|---|---|---|---|
| CA | 1194695 | A1 | 10/1985 |
| EP | 0581516 | A1 | 2/1994 |
| EP | 0926248 | A1 * | 6/1999 |
| WO | 2004082867 | A2 | 9/2004 |

* cited by examiner

*Primary Examiner* — Scott Kastler
(74) *Attorney, Agent, or Firm* — SmithAmundsen LLC; Kelly J. Smith; Dennis S. Schell

(57) ABSTRACT

A receptacle for handling molten metal is provided. The receptacle has bottom and side walls and includes a refractory defining a cavity within which the molten metal is conveyed or contained. The receptacle has at least one channel extending within at least one of its walls. The channel has an inlet and an outlet. The inlet is connectable to a source for circulating a fluid within the channel. The outlet allows the fluid to be expelled from said channel. The channel allows, when the fluid is circulated in it, to regulate the temperature of the refractory and thereby of the metal conveyed or contained. A casting assembly and a method for casting the refractory are also provided.

20 Claims, 15 Drawing Sheets

RECEPTACLE FOR HANDLING MOLTEN METAL, CASTING ASSEMBLY AND MANUFACTURING METHOD

CROSS-REFERENCE TO RELATED APPLICATIONS

This is a nonprovisional patent application of U.S. Provisional Patent Application No. 61/659,624, filed Jun. 14, 2012, and titled Receptacle for Handling Molten Metal, Casting Assembly and Manufacturing Method, which is incorporated herein by reference

FIELD OF THE INVENTION

The present invention relates to the field of devices used for conveying, containing, or filtering molten metals, such as aluminum. More particularly, it concerns a receptacle and an assembly for maintaining the temperature of the molten metal during handling. The present invention also relates to a casting assembly for casting the refractory of the receptacle or assembly, and to a manufacturing method.

BACKGROUND OF THE INVENTION

In the metal industry, such as the aluminum industry, liquid metal is transferred from a location to another using heated trough or launder having a general U-shape cross-section, and including a castable refractory. An example of a prior art launder section 1 is shown in FIG. 1. The refractory 2 is contained in a steel support 8 having a similar U-shape. Insulating layer(s) 4 are placed around the refractory to help maintaining the temperature of the liquid metal and to limit heat losses by conduction. The troughs are usually pre-heated using hot air blowers, gas burners, or heated covers. Heated covers are most commonly provided with electrical heating elements. Heating panels 6 can also be located on the side of each sidewall of the refractory 2, as best shown in FIG. 1A.

Examples of such installations are described in patent applications WO 2004/082867 and US 2010/0109210 pertaining to the Applicant. While efficient, one drawback of the side-mounted heating troughs is that they are subject to infiltrations of liquid metal. In addition, their maintenance and replacement can be difficult. Heated covers are subject to metal splashing and mechanical abuse, shortening their useful life. Existing heated covers or side-mounted heating panels also tend to be rather cumbersome and expensive.

In light of the above, there is a need for improved devices that allow to maintain molten metal in a liquid state, and that also allow to be operated, maintained, and/or replaced in a simpler fashion. It would also be desirable if such devices or method had a lower cost than existing devices while remaining relatively easy to manufacture.

SUMMARY OF THE INVENTION

A receptacle for handling molten metal is provided. The receptacle has bottom and side walls which comprise a refractory. The refractory defines a cavity within which the molten metal is conveyed or contained. The receptacle comprises at least one channel extending within at least one of the walls. The channel has an inlet and an outlet. The inlet is connectable to a source for circulating a fluid within the channel. The outlet allows the fluid to be expelled from the channel. The channel allows, when the fluid is circulated therethrough, to regulate the temperature of the refractory and thereby of the metal conveyed or contained.

In an embodiment, the receptacle is for a launder section. The side walls comprise two opposed side walls, the two opposed side walls and the bottom wall provide the receptacle with a U-shape with two opened extremities. Each side wall has an inner surface facing toward the cavity, an opposed outer surface, a top surface and opposed end surfaces at the opened extremities.

In an embodiment, the receptacle for a filter box and comprises two pairs of opposed side walls, each side wall has an inner surface facing toward the cavity, and an opposed outer surface (20).

In an embodiment, an assembly is provided, which includes the receptacle and the source for circulating the fluid within the at least one channel.

In an embodiment, an assembly is provided, which includes the receptacle and a deflector connected to the outlet of the at least one channel, for directing the expelled fluid toward the refractory.

A casting assembly for casting the refractory is also provided. The casting assembly comprises a core for forming the at least one channel and a mold having a hollow shape.

A method for casting the refractory is also provided. The method comprises the steps of:

- providing a casting assembly as described above;
- inserting the core within the mold;
- pouring a castable composition of precusors of a refractory paste into the mold;
- allowing the composition to solidify;
- heating the castable composition of step d); and
- removing the core from the cured refractory.

Advantageously, the receptacle can be heated by blowing a fluid (heated, ambient or cooled air, gas or liquid) which heats, maintains or cools the entire receptacle (or refractory), so that, when in use, the refractory in turns regulate the temperature of the molten liquid conveyed, contained or filtered. The receptacle and resulting assemblies are simpler and less cumbersome than existing solutions, yet they allow maintaining the molten metal in a liquid state, at a desired temperature. The manufacturing of the refractory remains relatively easy. Launders and filter box made with the receptacle of the present invention are also easy to install, operate, maintain and replace.

BRIEF DESCRIPTION OF THE DRAWINGS

Other objects, advantages, and features of the present invention will become more apparent upon reading the following non-restrictive description of preferred embodiments thereof, given for the purpose of exemplification only, with reference to the accompanying drawings in which.

DESCRIPTION OF PREFERRED EMBODIMENTS

Figure 1A:
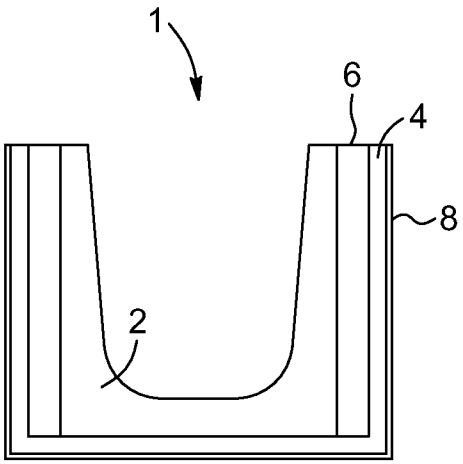
FIG. 1A (PRIOR ART)
FIG. 1A is a front view of the launder section of FIG. 1.
Figure 1:
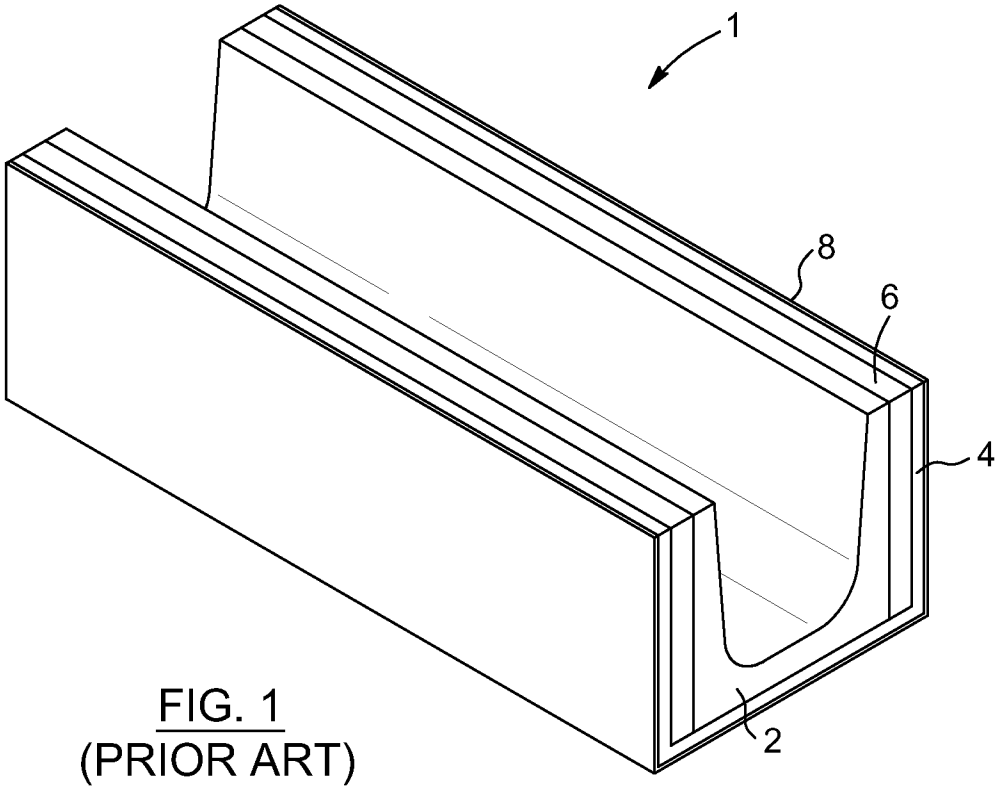
FIG. 1 (PRIOR ART)
FIG. 1 is a perspective view of a prior art launder section, provided with side-mounted heating panels.
Figure 2:
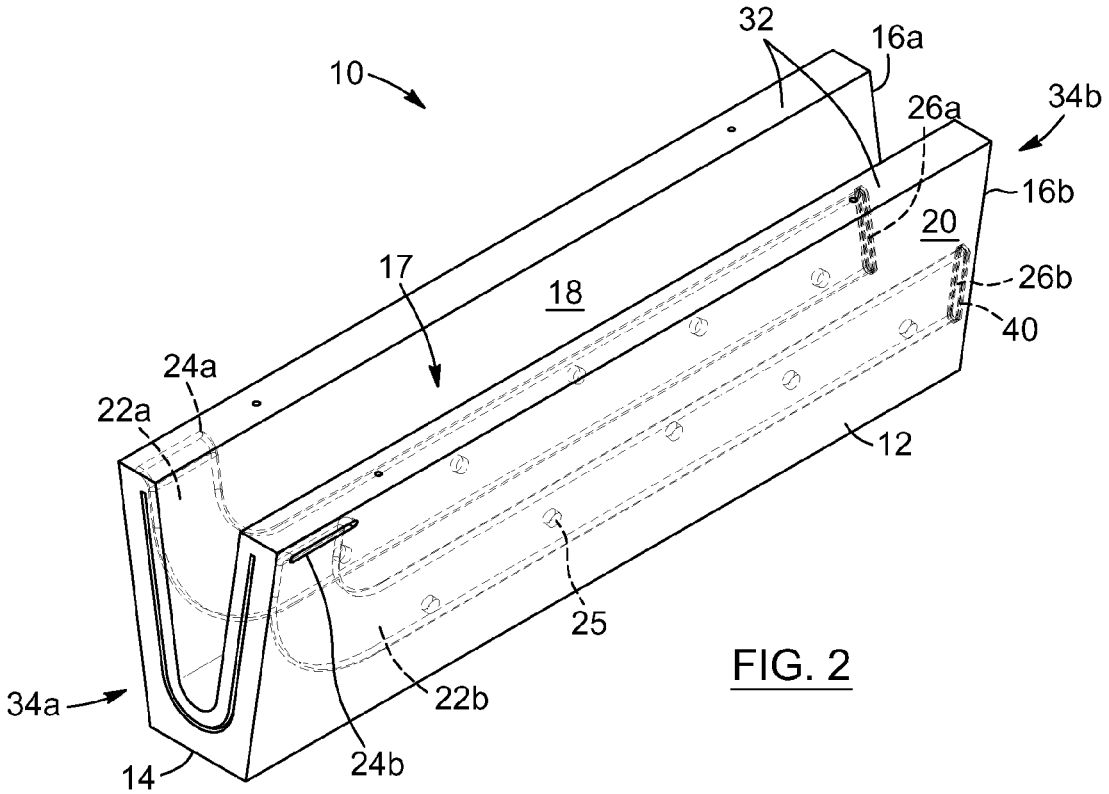
FIG. 2 is a perspective view of a receptacle according to a first embodiment of the invention.
Figure 2A:
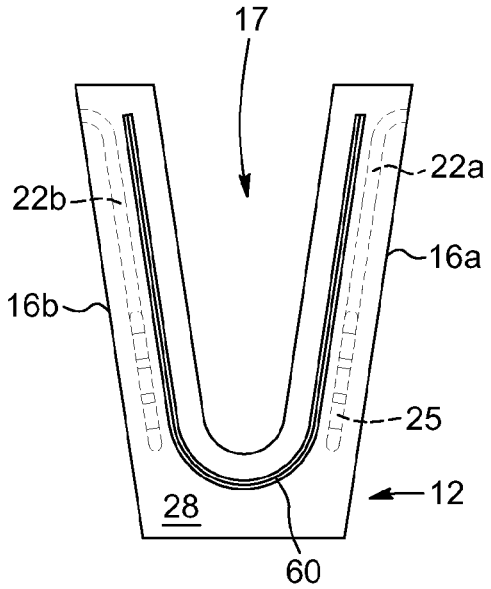
FIGS. 2A to 2C are respectively a front view, a side view, and a top view of the receptacle of FIG. 2.
Figure 2B:
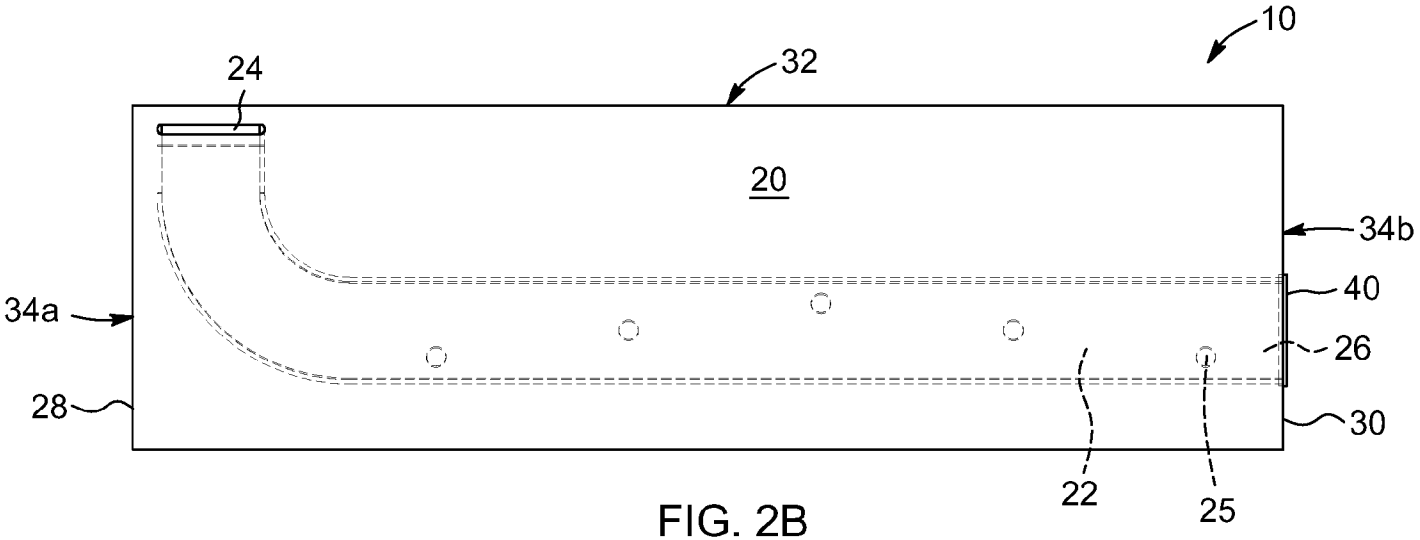
Figure 2C:
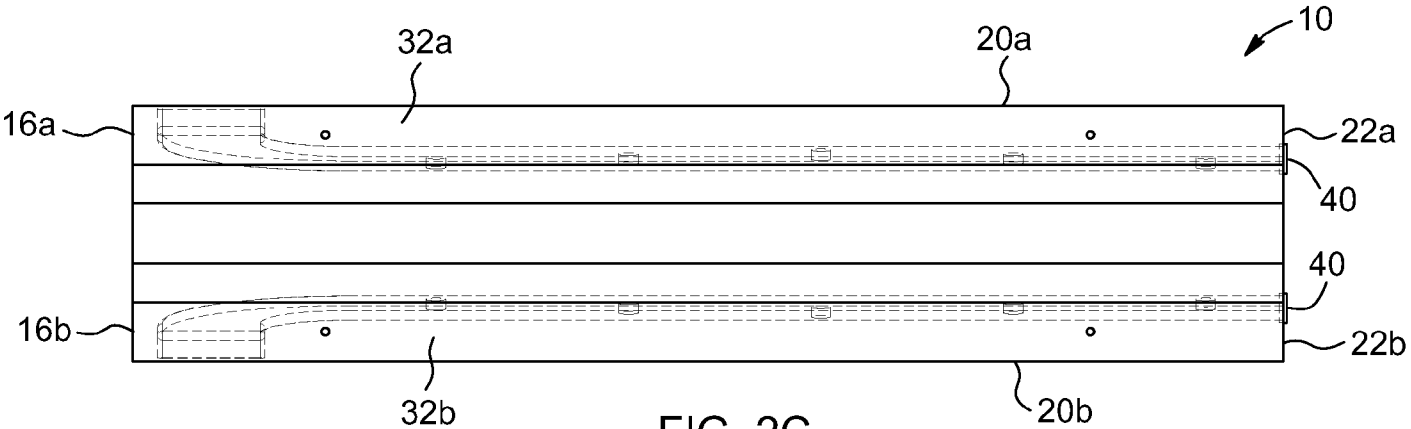

In the following description, similar features in the drawings have been given similar reference numerals. For the sake of clarity, certain reference numerals have been omitted from the figures when they have already been identified in a preceding figure.

Generally speaking, the present invention consists in providing at least one channel within a receptacle for conveying or containing molten metal, the receptacle including a refractory.

By refractory, it is understood to mean a composition that can be shaped or molded and then subsequently heated, fired, or calcined at a suitable temperature resulting in a hard, tough ceramic-like structure. Highly conductive refractory material such as silicon-carbide based, silica containing silicon carbide or alumina or a composition of these compounds can be used.

The channel(s) allow(s) blowing or pushing a fluid through it, which by conduction and/or convection will regulate the temperature of the refractory. The fluid pushed within the channel can be heated, cooled or at ambient temperature. Such receptacle is advantageously less subject to infiltrations of liquid metal. While the casting of the refractory may be slightly more complex than that for existing refractory bodies, the overall resulting receptacle and/or assembly, may it be the section of a trough, a launder, or a filter box, is likely to be easier to install, operate, maintain, and replace. The fluid source can advantageously be located outside or away from the portion of the receptacle conveying or containing the molten metal, and there are no mobile parts or electrical contraption likely to be in contact with the liquid metal.

Referring to FIGS. 2, and 2A to 2C, a receptacle 10 is shown, according to a first embodiment of the invention. The receptacle is a section of a launder, or trough, for conveying molten metal. The receptacle 10 has a bottom wall 14 and two side walls 16*a*, 16*b*. The walls include a refractory 12 defining a cavity 17 within which the molten metal is to be conveyed or contained.

The receptacle 10 has two channels 22*a*, 22*b* extending within its respective walls 16*a*, 16*b*. The channels extend longitudinally within the side walls 16*a*, 16*b*. Of course, it can be considered to have a channel 20 extending transversally instead. Alternatively, it can also be considered to place a channel within the bottom wall 14 as well, or in replacement of the ones within the side walls 16*a*, 16*b*.

The channels 22*a*, 22*b* have an elongated cross-section, but of course, other shapes and configuration for the channels can be considered. For example, the wall defining a channel can be provided with ribs, riblets and/or grooves, for increasing the thermal exchange surface. Providing the refractory with long and narrow channel(s) advantageously allows increasing the transfer surface between the channel and the refractory, in turn increasing the transfer of heat from the fluid to the refractory.

In this preferred embodiment, the receptacle 10 is provided with a plurality of rods 25 extending transversally within the channels. The rods 25 help maintaining structural integrity of the refractory 12. The rods 25 also promote turbulence within the channels when fluid is circulated, for improving thermal exchanges with the body of the refractory. In the present case, the rods 25 are formed of the refractory material 12, during the casting process, as will be explained in more detail later on in the description.

Each channel 22*a*, 22*b* has an inlet 24*a*, 24*b* and an outlet 24*a*, 24*b*. The inlets 24*a*, 24*b* are connectable to a source for circulating a fluid, such as heated air, within the channels. The outlet 26*a*, 26*b* allow the fluid to be expelled from the channels. When the fluid is circulated within the channels, it modifies, regulates or maintains the temperature of the refractory 12 and, as a consequence, of the metal conveyed or contained within the receptacle. For example, heated air can be circulated within the channels, to increase the temperature of the refractory, such that when molten metal is circulated in it, the temperature of the metal is maintained. Alternatively, cooled or air at ambient temperature can be circulated within the channels, to cool down the refractory and at the same time, the molten metal handled in the receptacle.

In the present case, the refractory is a calcined castable refractory for use as part of a launder or trough, for conveying liquid metal. The receptacle 10 has a U-shape cross-section and two opened extremities 34*a*, 34*b*. Each side wall 16*a*, 16*b* has an inner surface 18 facing toward the cavity, an opposed outer surface 20, a top surface 32 and opposed end surfaces 28, 30 at the opened extremities 34*a*, 34*b*. The inner surface 18 defines the cavity 17 in which the molten metal is to be conveyed or contained, and the inlets 24*a*, 24*b* and outlets 26*a*, 26*b* open near the outer extremities 34*a*, 34*b*, either on the end or outer surfaces 20, 28, 30 of the refractory 12.

Still referring to FIGS. 2 and 2A to 2C, the receptacle shown is an end launder section for a launder assembly. The two opened extremities 34*a*, 34*b* are defined by respective transversal surfaces 28 and 30. Each of the two channels 22*a*, 22*b* has a substantially L-shape. For each channel 22*a*, 22*b*, the inlet opens on the outer surface 20 of the refractory, near the top surface 32*a*, 32*b* of the corresponding side wall. The outlets 26*a*, 26*b* open on the transversal surface 30 of the section. Of course, the inlets and outlets could be located elsewhere on the receptacle 10. Preferably, sealing elements 40 are used for sealingly connecting the channels of a given receptacle to channels of an adjacent receptacle.

Figure 3:
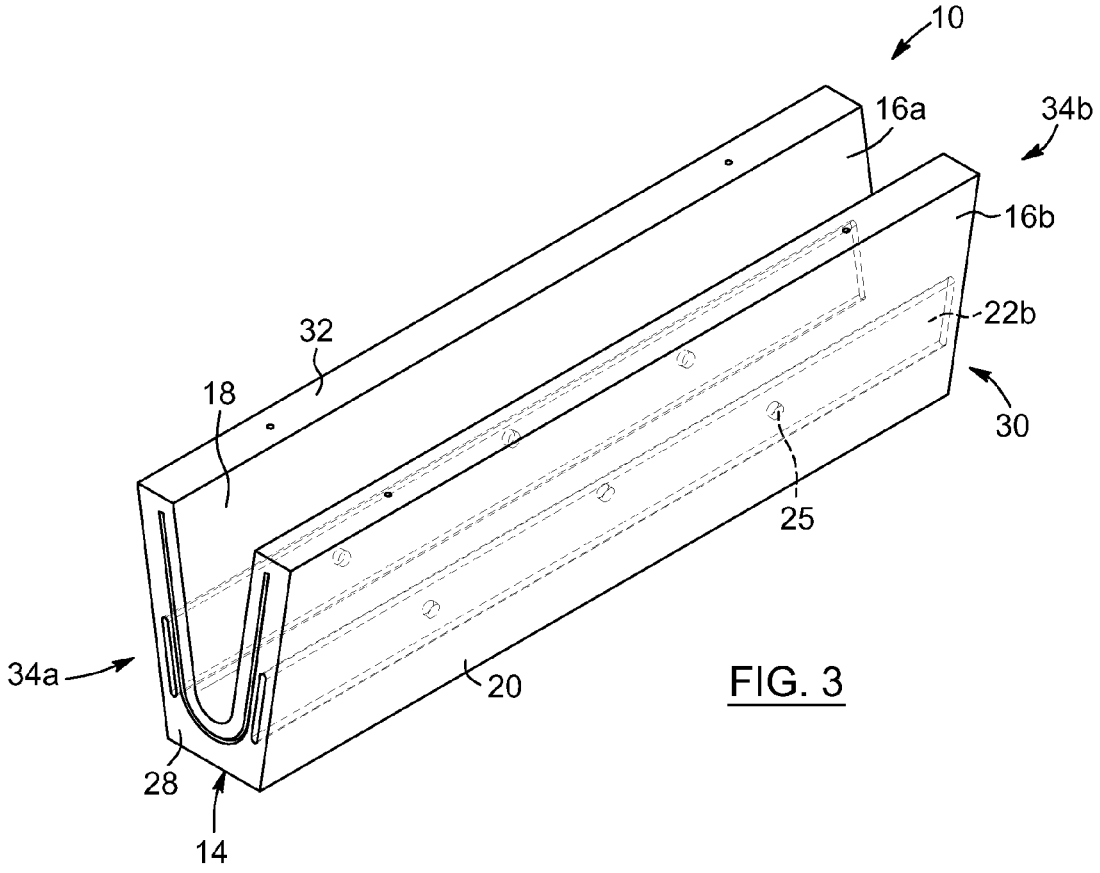
FIG. 3 is a perspective view of a receptacle according to a second embodiment of the invention.
Figure 3A:
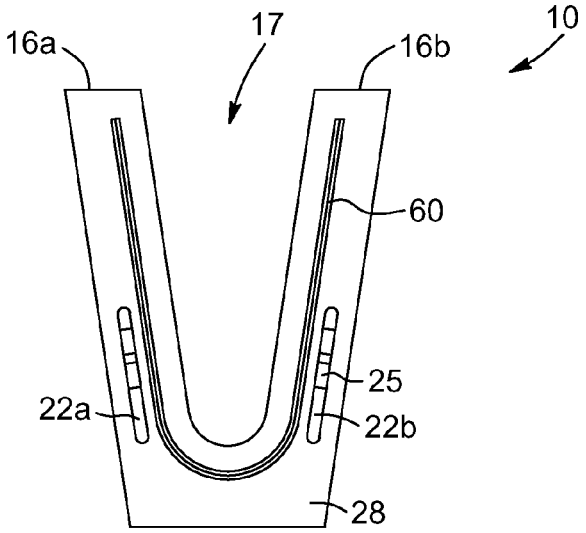
FIG. 3A is a front view of the receptacle of FIG. 3.

Now referring to FIGS. 3 and 3A, yet another embodiment of a receptacle 10 for forming a section of a launder or a trough is shown. In this case, the receptacle 10 is a middle launder section of a launder assembly. The two opened extremities 34*a*, 34*b* are defined by the transversal surfaces 28, 30. In this case, the two channels 22*a*, 22*b* have their inlets opening on the transversal surface 28 and their outlets opening on transversal surface 30, for allowing connection of the channels 22*a*, 22*b* to corresponding channels of an adjacent launder section. The channels 22*a*, 22*b* extend longitudinally within the walls 16*a*, 16*b* of the receptacle 10, and they are also provided with rods 25, made from the refractory 12.The extremities 34*a*, 34*b* are preferably provided with section sealing elements 60, which allow to sealingly connect adjacent sections of a launder or trough. Sealing elements 60 can be made of any convenient material, but RFM® bushings are preferred. RFM® is a composite ceramic material that is both tough and tolerant to mild mechanical abuse. This material is hard-wearing and very insulating. Of course, other types of seals or bushings can be considered, as long as they allow to sealingly connect the channels of the different sections with one another. Optionally, the receptacle can include a heating element 35 located within the at least one channel.

Figure 4:
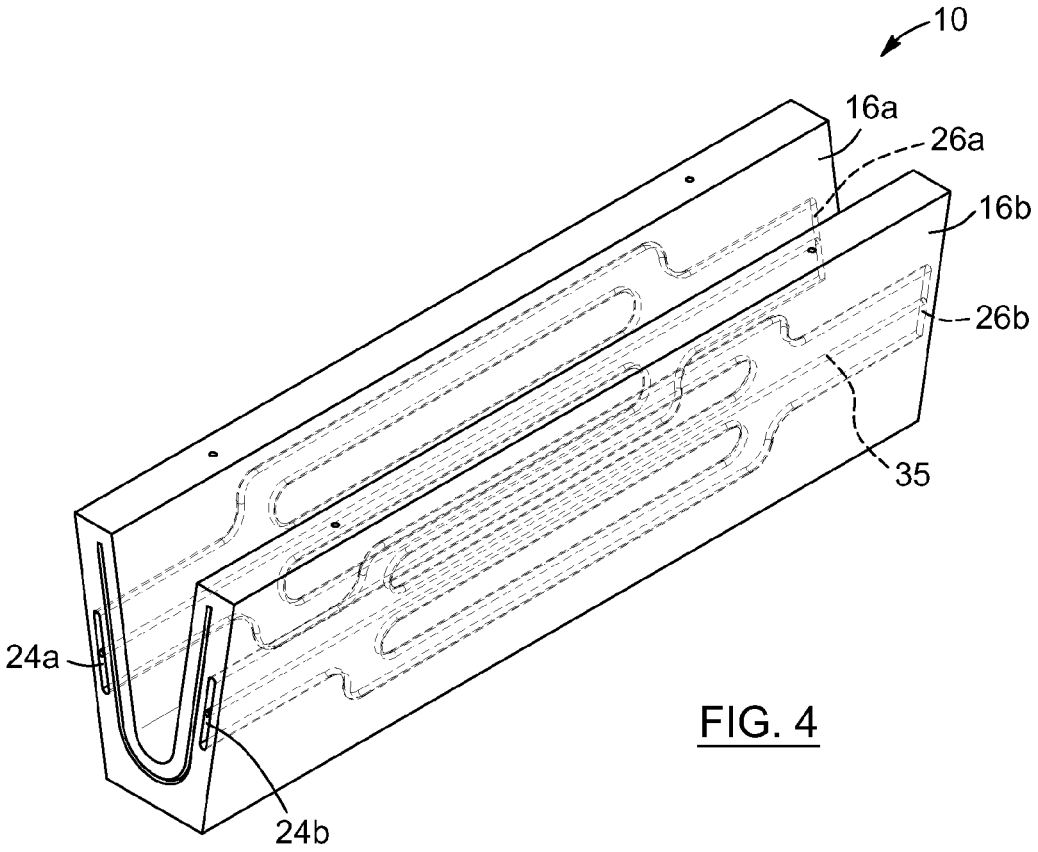
FIG. 4 is a perspective view of a receptacle according to a third embodiment of the invention.
Figure 4A:
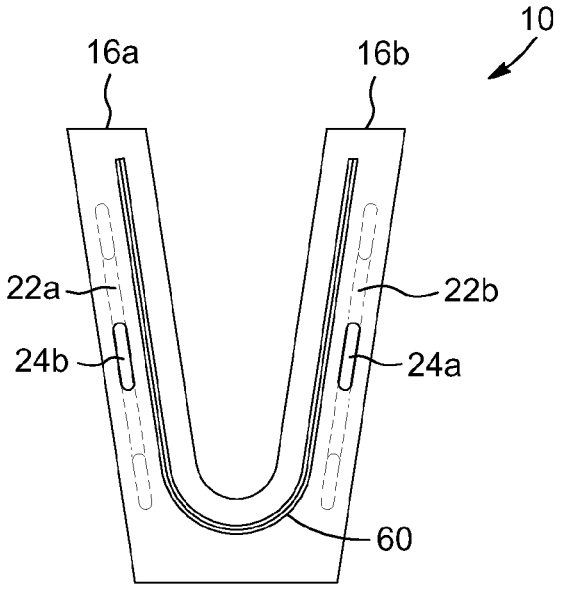
FIGS. 4A is a front view of the receptacle of FIG. 4.
Figure 5A:
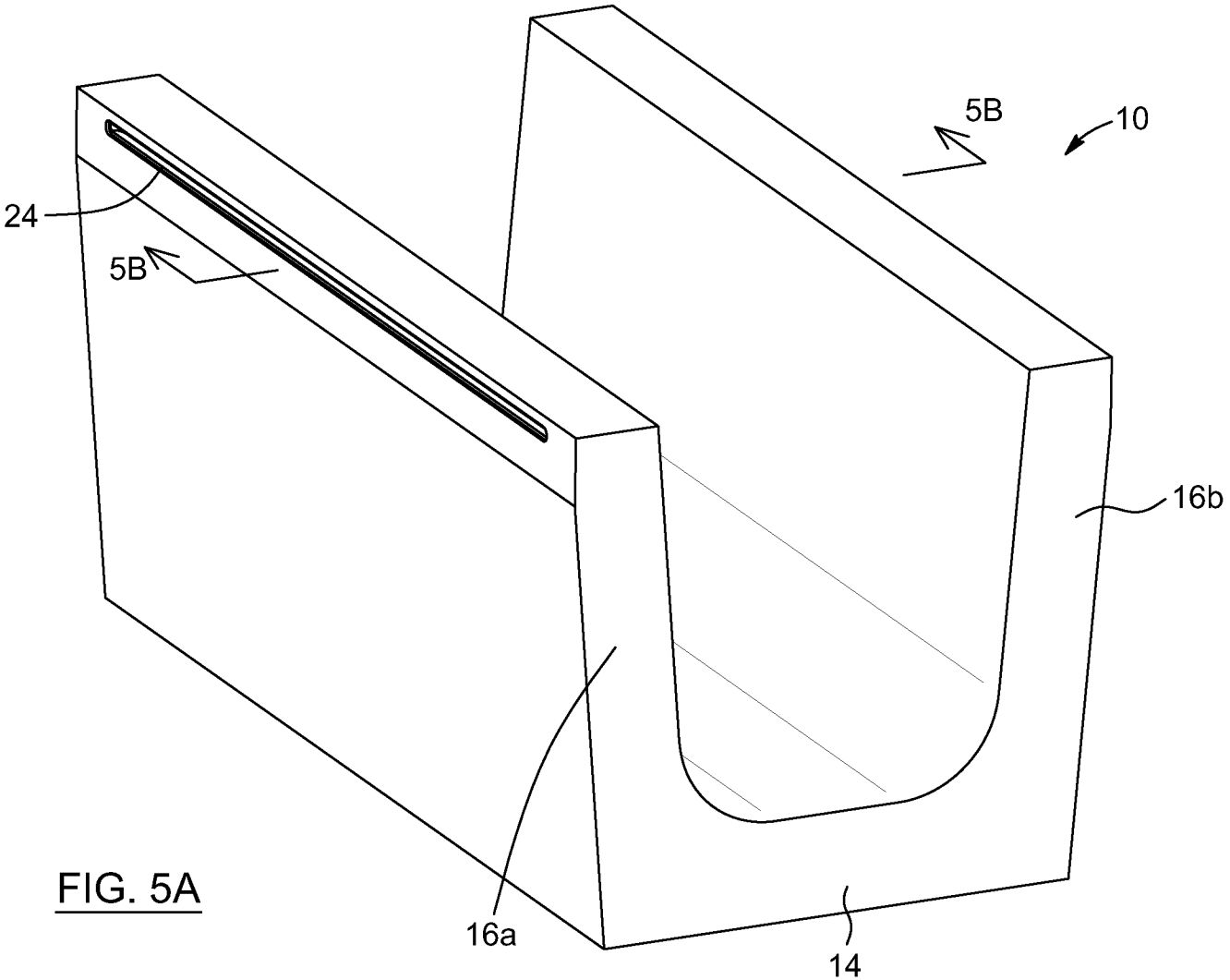
FIG. 5A is a side perspective view of a receptacle according to a fourth embodiment of the invention.
Figures 5B, 5C:
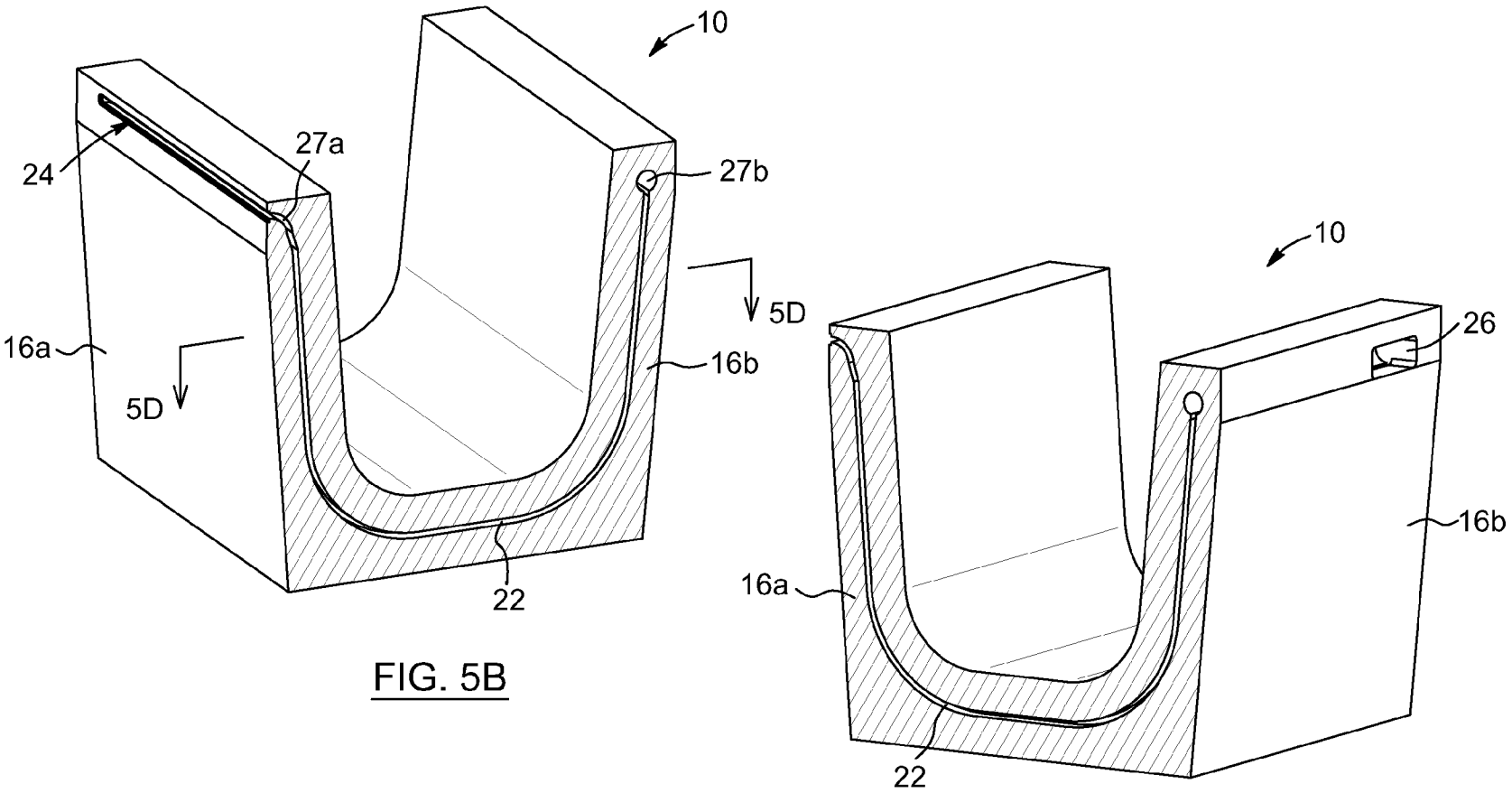
FIG. 5B is a transversal cross-section view of the receptacle of FIG. 5A.
FIG. 5C is another cross-section view of the receptacle of FIG. 5A.
Figure 5D:
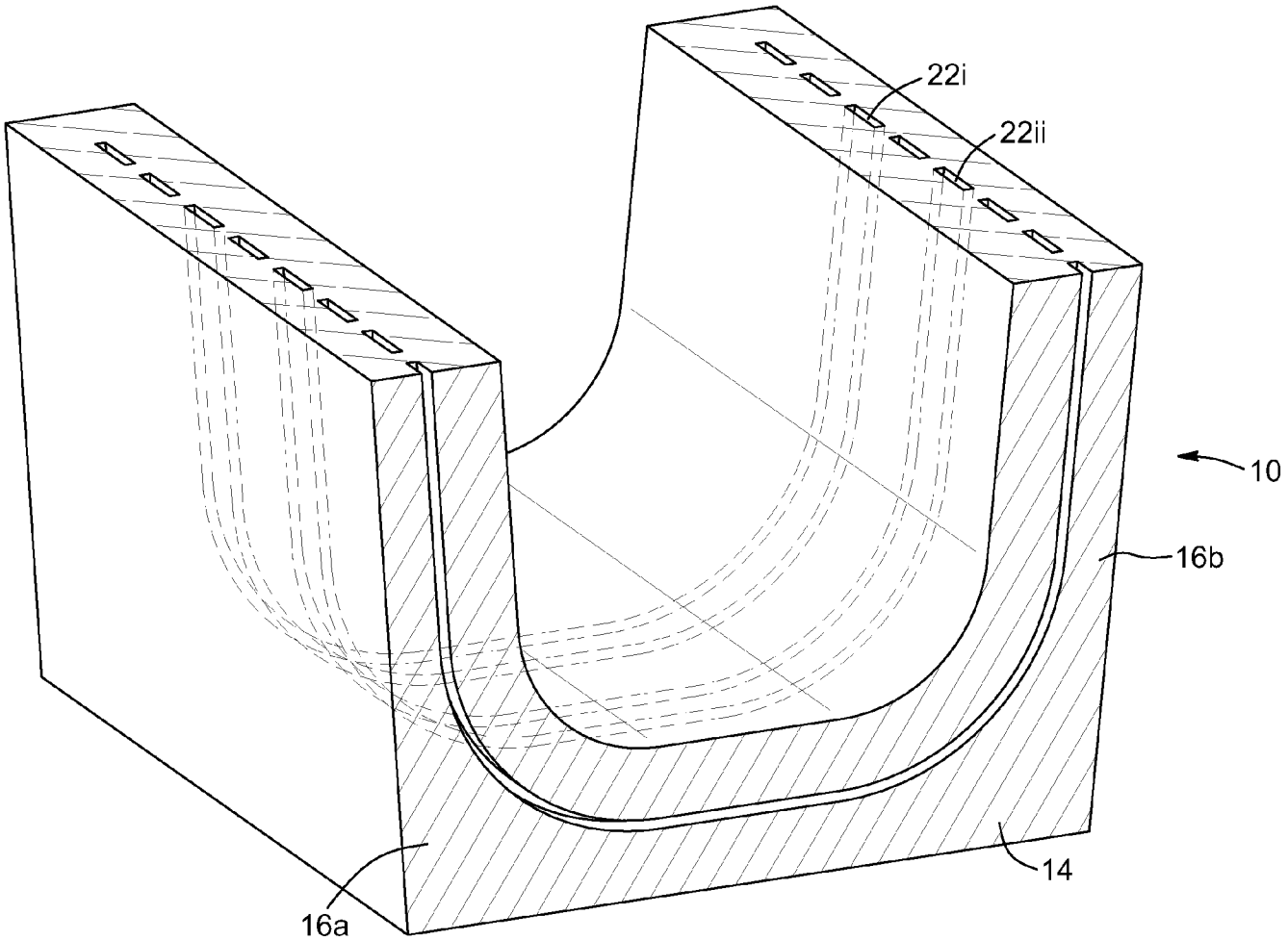
FIG. 5D is a longitudinal cross-section view of the receptacle of FIG. 5B.

Referring to FIGS. 4 and 4A, yet another embodiment of a middle launder section is shown. In this case, each channel includes several sub-channels which unite near the inlet 24*a* or 24*b* and the outlet 26*a* or 26*b*. In this embodiment, the sub-channels include two outer sub-channels and one middle sub-channel. It can be considered that the cross-section of the middle sub-channel be smaller than the cross-section of either one of the outer sub-channels. Such configuration would advantageously allow distributing more evenly the flow of hot air through the sub-channels. Of course, other shapes or configurations of the channels can be considered.

Referring now to FIGS. 5A to 5D, different views and cross-sections of another embodiment of a receptacle 10 are shown. This receptacle 10 can be used as a launder section for a degassing system, such as an ACD (Aluminum Compact Degassing) system in the aluminum industry. In this case, the receptacle 10 includes several sub-channels 22*i* (only two are identified 22*i*, 22*ii*) which extend transversally within the side and bottom walls 16*a*, 16*b*, 14 of the receptacle 10.

The receptacle 10 has a first longitudinal collecting channel (27*a*) extending within the side wall (16*a* ), which connects to the inlet (24), and a second longitudinal collecting channel (27*b*) extending along another the side walls 27*b*, connected to the outlet 26. In the present case, the inlet has the shape of a longitudinal slot extending near the top end of the wall 16*a*.

Figure 6:
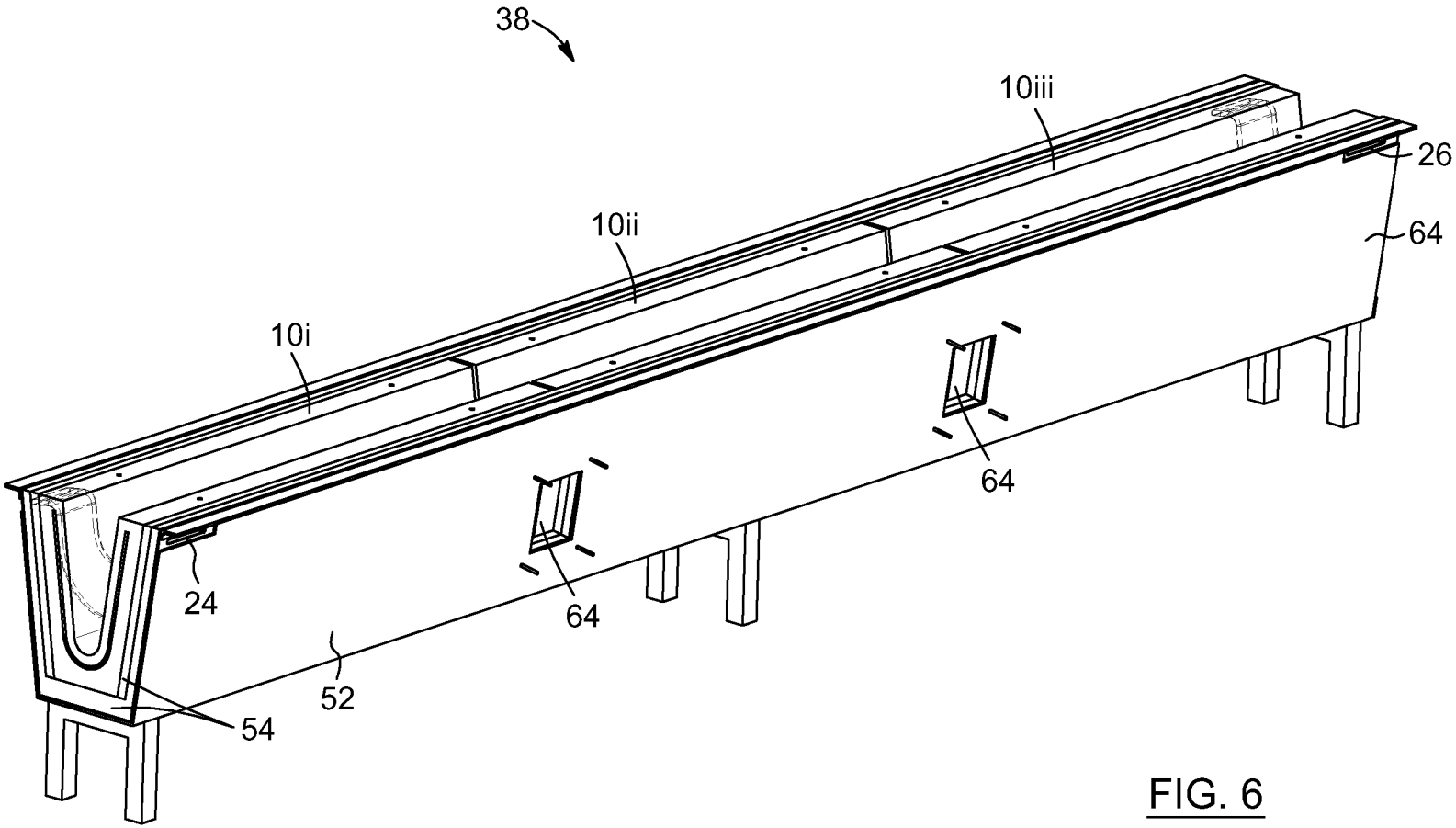
FIG. 6 is a perspective view showing a launder assembly including several launder sections, according to a fifth preferred embodiment of the invention.

Turning now to FIG. 6, an assembly 38) for conveying molten metal is shown. This assembly 38 is a launder assembly. The assembly 38 includes several receptacle or launder sections 10*i*, 10*ii*, 10*iii*, such as those shown in FIGS. 2 to 4A. Each channel of a given receptacle 10*ii* communicates with a corresponding channel of at least one adjacent receptacle 10*i* or 10*ii*. The communicating channels thus form one communication path within the launder assembly 38, through which fluid can be circulated. The outlet of a receptacle can thus be connected to the inlet of an adjacent receptacle. The channels of adjacent sections do not need to communicate directly with one another, external tubing can be used to connect the channels to one another, for example in the case where the inlets and outlets are provided on the top surface of the receptacle. In this case the communicating channels do not need to be sealingly connected.

The assembly 38 is supported by a structure (52) for supporting the launder sections 10*i*, 10*ii*, 10*iii*.

The assembly 38 preferably include channel sealing elements for sealingly connecting the channels of adjacent sections, such as RFM® bushings or the like. Optionally, access openings 64 are provided in the assembly, the openings 64 being located so as to face the connected extremities of the launder sections 10*i*, 10*ii*, 10*iii*, for facilitating maintenance or replacement operations.

Figure 7:
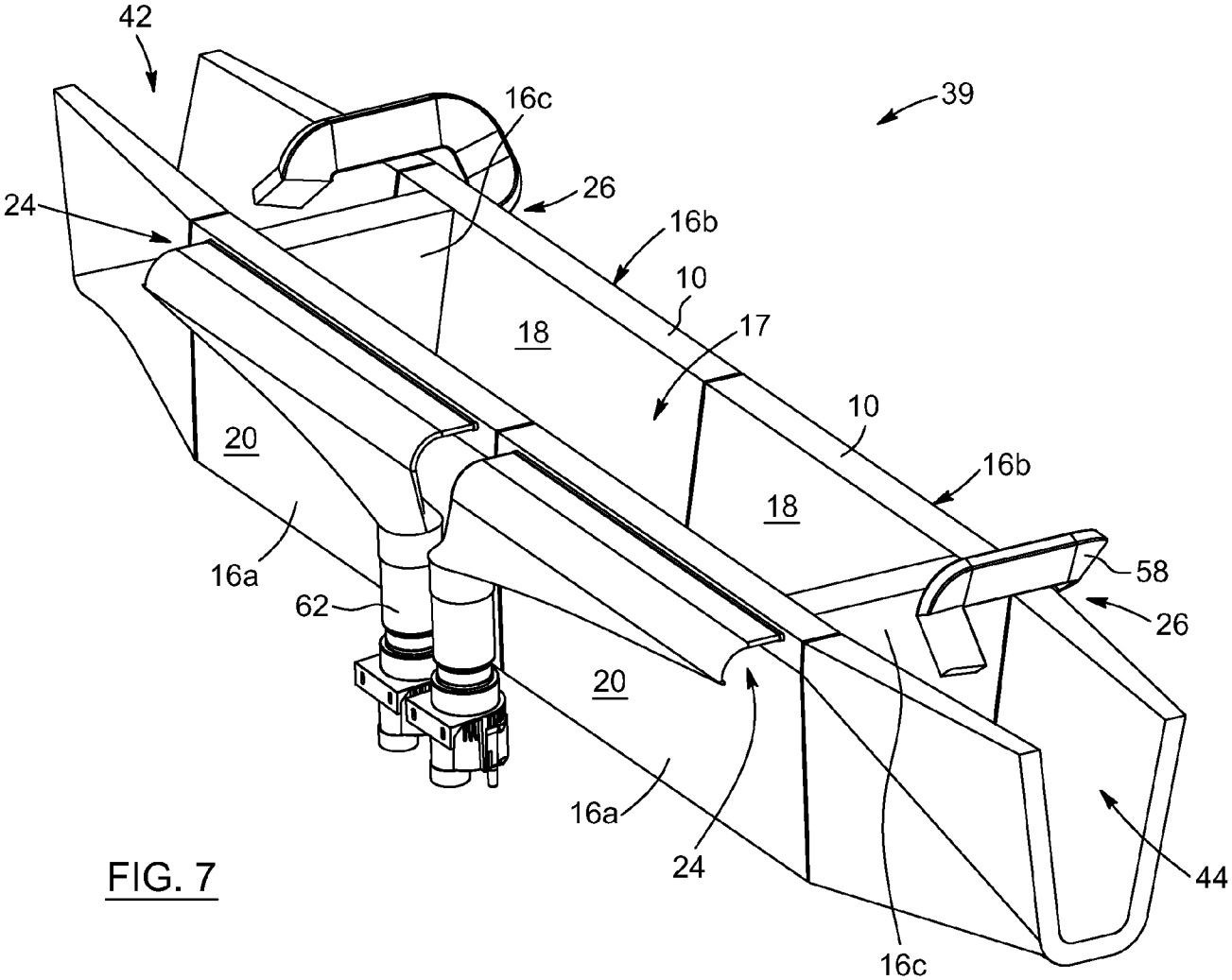
FIG. 7 is a perspective view showing another launder assembly, including two launder sections, according to a sixth preferred embodiment of the invention.
Figure 7A:
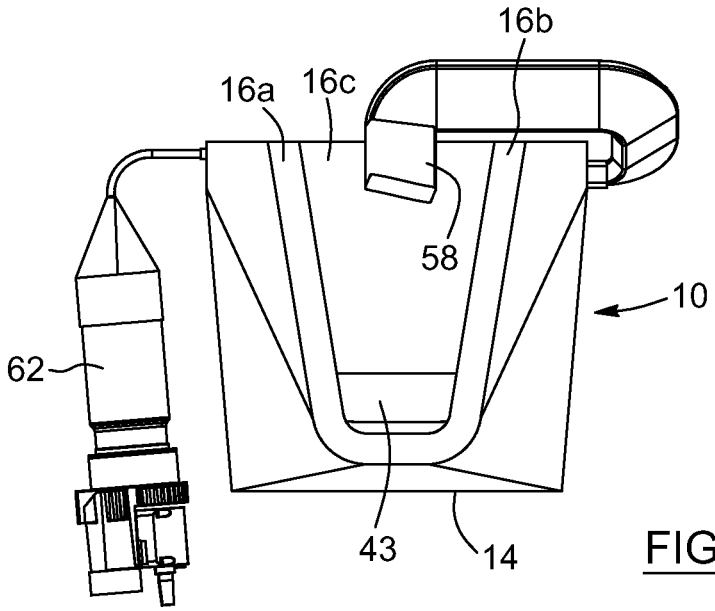
FIG. 7A is a front view of the launder assembly of FIG. 7.

Referring to FIGS. 7 and 7A, another assembly 39 is shown. In this case the assembly 39 is a launder or trough for conveying molten metal in a degassing system. The assembly includes two receptacles 10*i*, 10*ii*. Each receptacle has a pair of opposed side walls (16*a*, 16*b*), a bottom wall 14, and an additional transverse side wall 16*c*. Each side wall 16*a*, 16*b* or 16*c* has an inner surface 18 facing toward the cavity 17, an opposed outer surface 20 and a top surface. The transverse side wall 16c is provided with an opening 43 which can serve as an entry 42 or an exit 44 for the molten metal.

The receptacles 10*i*, 10*ii* of the assembly 39 are used in combination with deflectors 58, connected to the respective outlets 26 of the channels 22, for redirecting the expelled fluid toward the refractory 12 or elsewhere. Of course, it can be considered to provide only one of the receptacles with a deflector. The deflector 58 can take different shapes and form, but is preferably a tube. The tube can be made of one or several articulated segments.

The assembly can include the source 62 for circulating the fluid within the channel(s). The source can include an air blower, a heating element or a refrigerating or a combination of these elements. Alternatively, or in combination with an air blower, a heating or refrigerating element can be placed within the channel of the receptacle(s). The blower can be integrated with the heat source, or separated from it. An heat source 62 used for providing heated fluid can be for example a Leister or Farnham air heater of 15 kW coupled to a blower having a capacity of 1200 L/min, generating a source of hot air, having a temperature of around 900° C.

Figure 8:
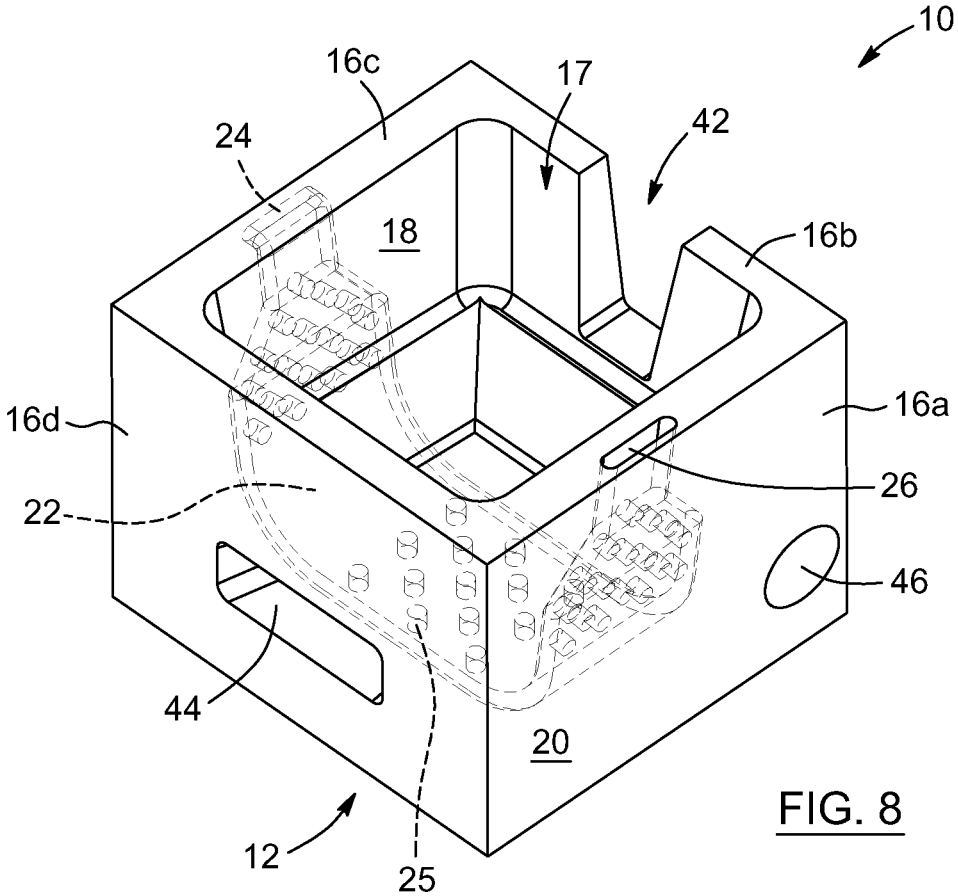
FIG. 8 is a perspective view of a receptacle for a filter box, according to a seventh preferred embodiment of the invention.
Figure 9:
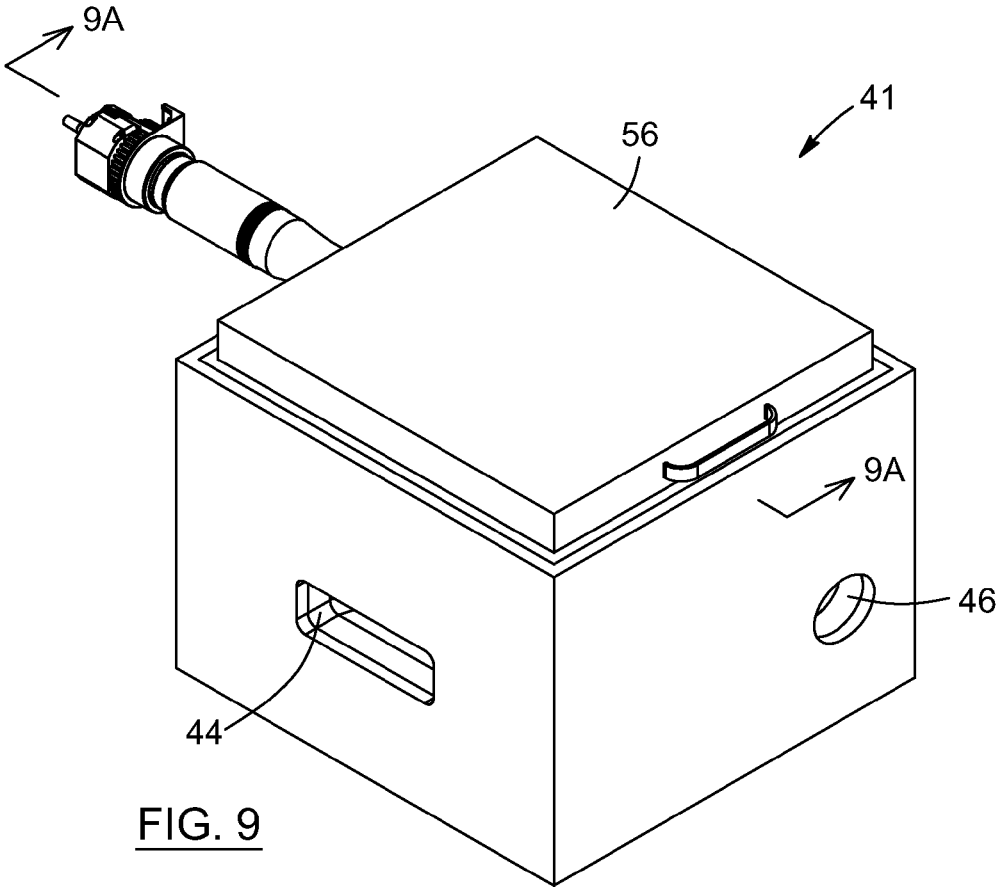
FIG. 9 is a perspective view of a filter box assembly, including the receptacle of FIG. 8, according to an eighth preferred embodiment of the invention.
Figure 9A:
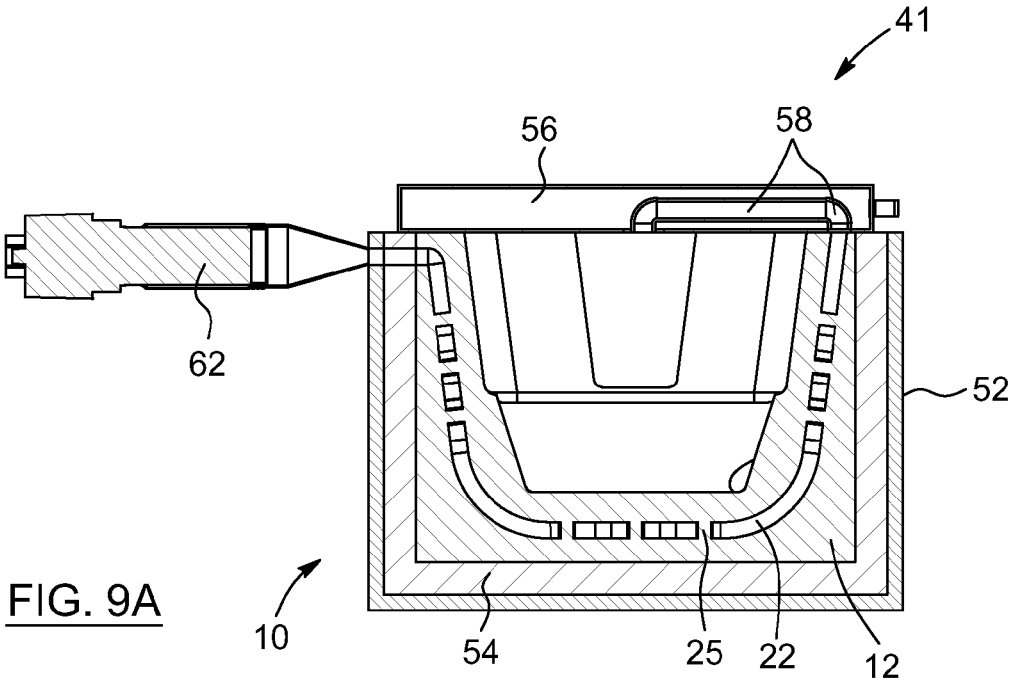
FIG. 9A is a cross-section view of the assembly of FIG. 9.

Referring to FIG. 8, another embodiment of a receptacle 10 is shown. In this case this receptacle can be used as part of a filter box assembly 41, such as shown in FIGS. 9 and 9A. The receptacle 10 includes two pairs of opposed side walls 16*a*, 16*b*, 16*c*, 16*d*, each side wall having an inner surface 18 facing toward the cavity 17, an opposed outer surface 20. The channel 22 extends within two opposed walls 16*a*, 16*c* and within the bottom wall 14. The channel 22 is crossed by several rods 25, for reinforcing the structural integrity of the walls, and for promoting turbulences within the channel 22 when fluid is circulated through it.

Side wall 16*b* is provided with a U-shape inlet or entry 42 connectable to a launder or trough, by which molten metal is received. Side wall 16*d* is provided with an outlet or exit 44 by which filtered aluminum can be discharged. Sidewall 16*a* is provided with a drain 46. Filter boxes, similar to launders or troughs, also need to be heated in order to maintain the molten metal at a proper temperature. Providing channels within the side walls 16*a*, 16*c*, and bottom wall 14 allows not only to keep the refractory material at a proper temperature, but also to avoid having to provide the filter box with a cover provided with cumbersome electrical heating circuits as currently existing in the art.

Referring to FIGS. 9 and 9A, the receptacle 10 is part of a filter box assembly, and preferably include a deflector 58. The filter box can include a cover 56, and the deflector 58 preferably passes through the cover, to redirect the expelled fluid within the cavity 17. A Ceramic Foam Filter (CFF) is typically placed at the bottom of the receptacle 10, to filter the molten metal. The porous filter must be heated enough in order to let the metal pass through it. The channel 22 provided in the refractory 12, through which a hot fluid can be blown or pushed, advantageously allows to keep both the filter and the box well-heated. The heated fluid exiting the channel can be redirected towards the porous filter placed in the bottom of the receptacle 10. This configuration advantageously allows heating the refractory 12 and the filter at the same time, with a single heat source. The filter box 41 assembly is preferably provided with an insulating layer 54, and with a support structure 52

Figure 10B:
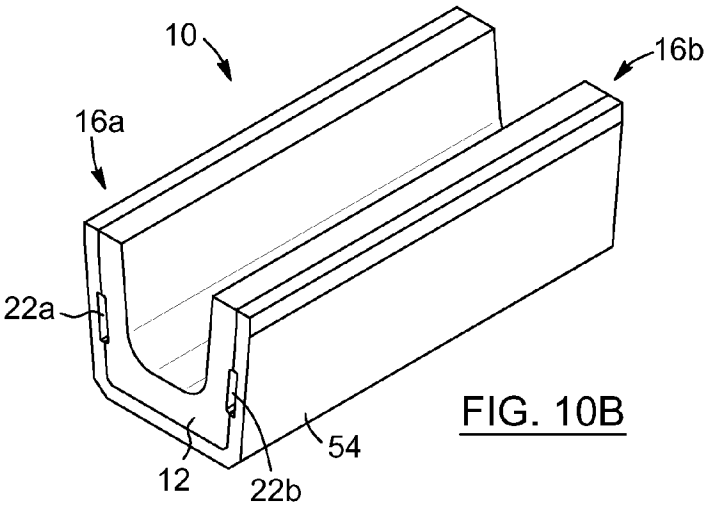
FIGS. 10A to 10C are perspective views of different embodiments of a receptacle, according to the invention.
Figure 10A:
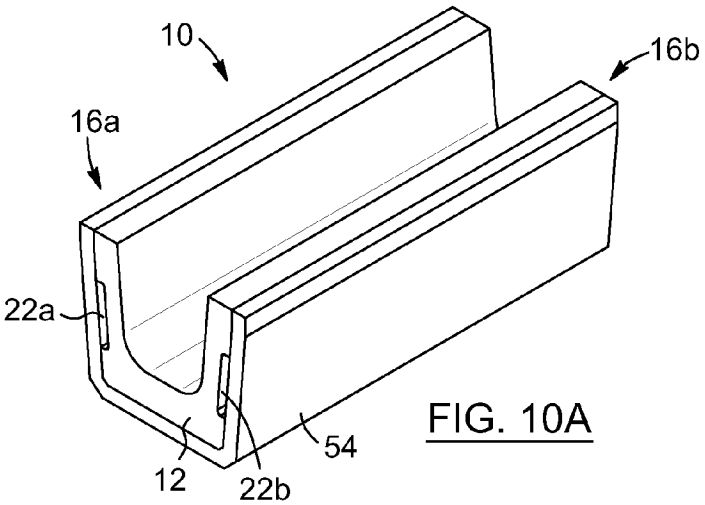
Figure 10C:
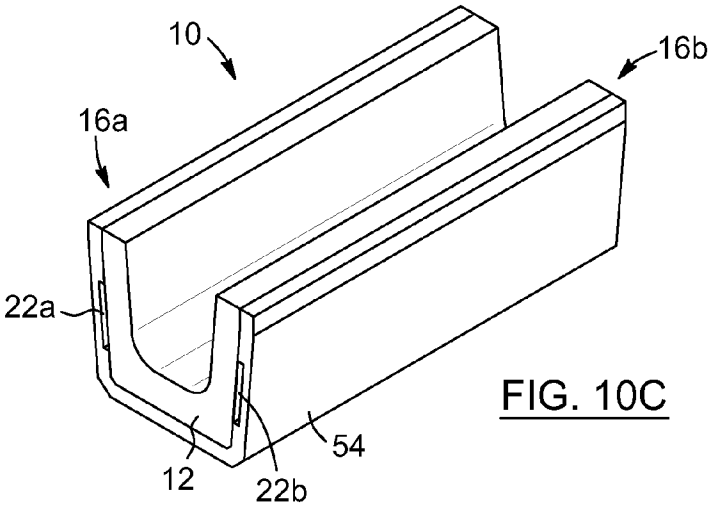

Referring to FIGS. 10A to 10C, other embodiments of a receptacle 10 are shown. In these embodiments, at least one and preferably all walls include(s) an insulating layer 54. In these embodiments, the channels 22 do not extend within the refractory 12, but are partially formed by an interface of the outer surface of the refractory 12, and of the inner surface of the insulating layer 54. In FIG. 10A, the respective channels 22 have three walls formed by a longitudinal groove on the outer surface of the refractory 12, and one wall by the inner surface of the insulating layer, the inner surface of the insulating layer 54 facing the outer surface of the refractory 12. In FIG. 10B, the inner surface of the insulating layer also includes a groove, facing a corresponding groove on the outer surface of the refractory 12, so as to form a channel. Finally, in FIG. 10C, a groove is provided in the insulating layer 54, so that when the insulating layer or panel is placed in contact with the outer surface of the receptacle 12, a channel 22 is formed. As can be appreciated, in these embodiments, the channel(s) extend between the refractory 12 and the insulating layer 54. The channel(s) can also extend with the insulating layer 54.

Figure 11A:
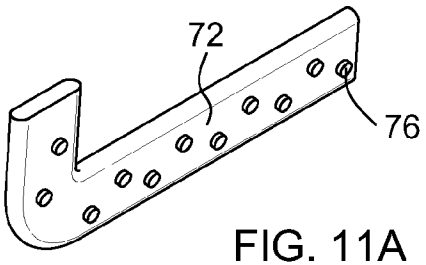
FIG. 11A is a perspective view of a core for forming a channel within a receptacle, according to a preferred embodiment.
Figure 11B:
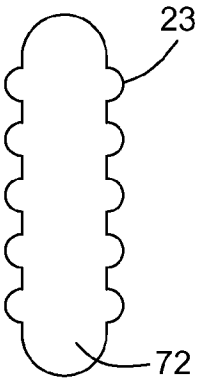
FIG. 11B is a front view of a core for forming a channel.
Figure 11:
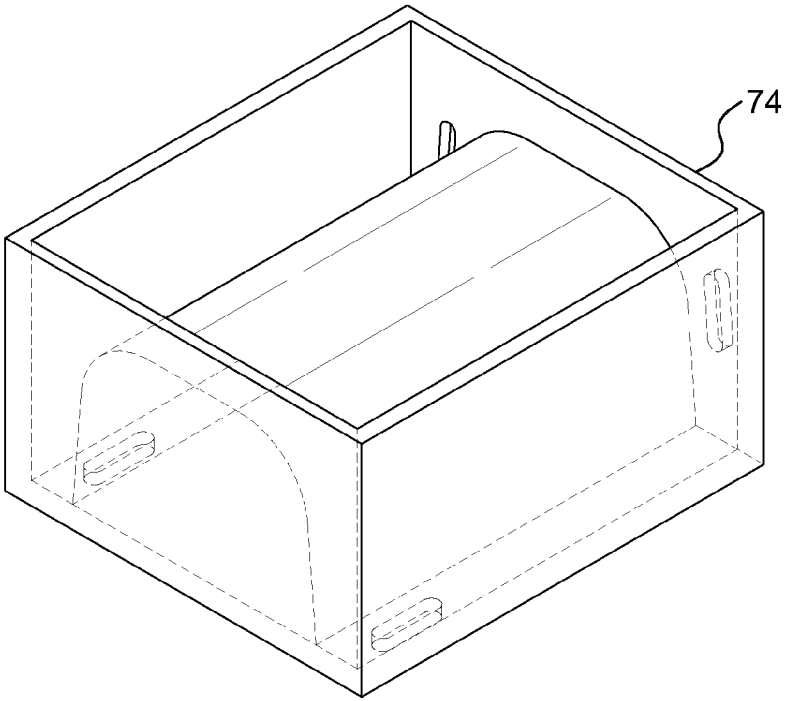
FIG. 11 is a perspective view of a casting mold, according to a preferred embodiment of the invention.

Now turning to FIGS. 11 and 11A, a casting assembly 70 used to cast the refractory of a receptacle according to invention is shown. This assembly could be used to form a receptacle similar to the one presented in FIG. 2. The casting assembly includes a mold 74 and a core 72. The core 72 is for forming a channel within the refractory. The core 72 has two ends and it is made of any convenient material which can be burned, pyrolyzed, removed, dissolve or disappear by the action of heat, of an acid or any other substance, once the refractory has set and has been heated. The core can thus be inflammable, removable or disintegrable. The core can be made of wood or of a polymer. Preferably, the core is made of a material rigid enough not to deform when the castable composition is poured into the mold 74. The core 74 is provided with holes 76, for forming the rods passing through the channel when the refractory is formed.

The mold 74 has a hollow shape, and includes openings for receiving respective ends of the core 72. The openings can allow the creation of the inlet 24 and outlet 26 of the channel 22, or can be used for retaining the core in place within the mold.

As shown in FIG. 11B, a front view of another embodiment of a core 72 is shown. The core is provided with ribs 23 for creating grooves on the side wall of the channel within the refractory. This view can also correspond to the outline of a channel provided in the refractory material. It is known that the heat transfer coefficient in air ducts is greater when the fluid is circulated in a swirling and turbulent motion, rather than in a laminar motion. As such, it can be considered to form the channel(s) with grooves in order to further increase the heat transfer surface between the channel and the refractory or insulating layer.

Figure 12B:
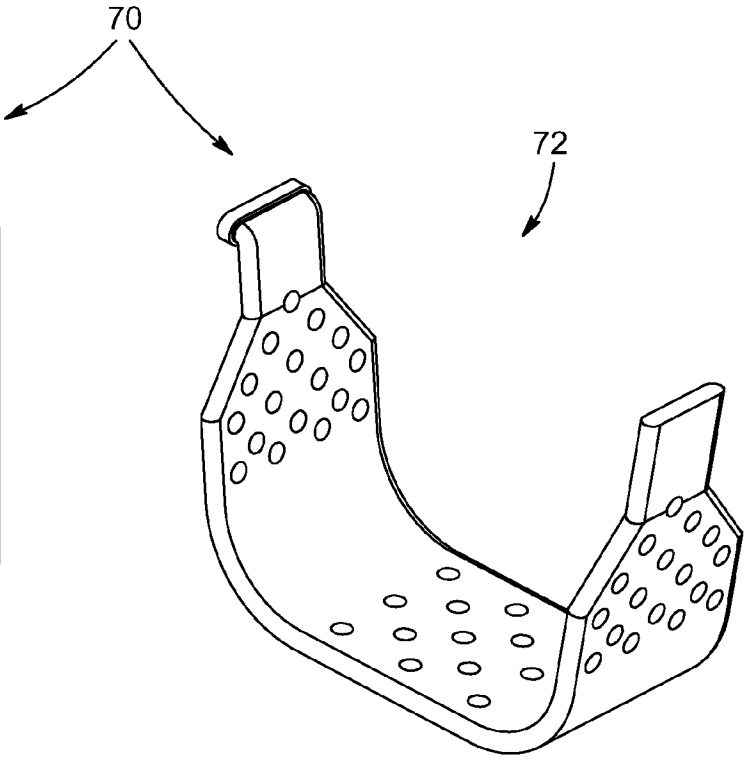
FIG. 12B is a perspective view of a core, for forming a channel within the refractory of a receptacle, according to a preferred embodiment of the invention.
Figure 12:
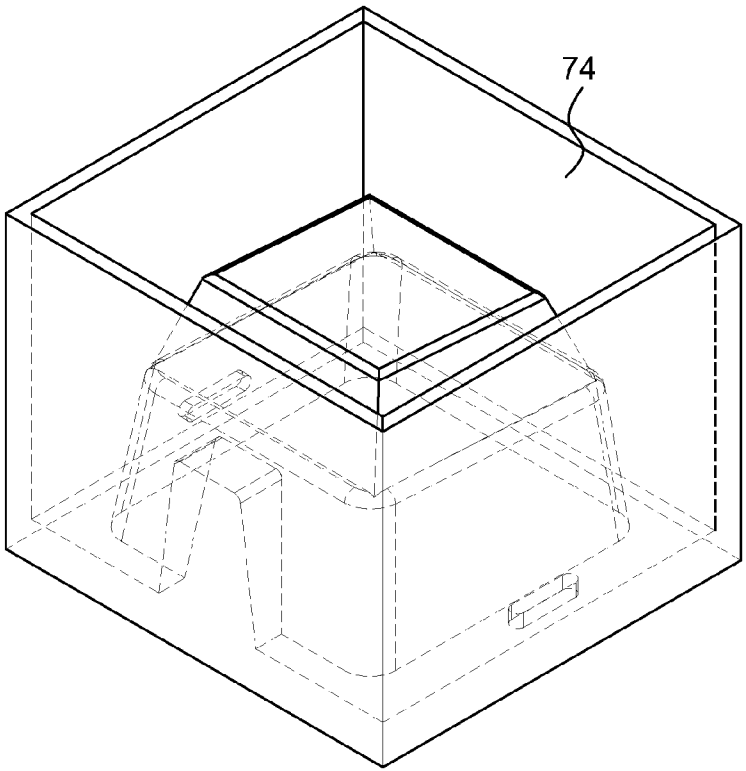
FIG. 12 is a perspective view of a casting mold, according to a preferred embodiment of the invention.

With reference to FIGS. 12 and 12B, another embodiment of a casting assembly 70 is shown. This assembly 70 can be used to form the refractory of a filter box. The casting assembly 70 includes a core 72 that has a U-shaped body while several openings extending through it. The casting assembly 70 also comprises the mold 74 that has a hollow shape corresponding to the body of the refractory. Other cores are of course used for forming the outlet (or exit) of the box, and for the drain (not shown on the Figure). The mold includes openings for receiving respective ends of the core 34. These openings allow the creation of the inlet and outlet of channel 22.

The present invention also concerns a method for forming a refractory receptacle as described in the preceding figures. The method consists of providing a casting assembly comprised of at least a mold and a core for forming the channel. The core is inserted in the mold prior to pouring the refractory material such that the ends of the core exit through their respective openings of the mold. Preferably, the mold is placed upside down such that its openings are facing the ground. A castable composition of precursors of a refractory material is poured into the mold. The composition is left to rest until it sets, and it can then be unmolded. The composition can be left to rest for another predetermined period, such as 24 hours. This composition then is heated until the refractory material is obtained. Heat used for this process will result in burning the core, if made of wood. Other materials can be used for the core, such as polymeric core, and they can be removed from the refractory by being dissolved by an acid or similar substance.

As it can be appreciated, the receptacle, the casting assembly, and the manufacturing method of the present invention advantageously allow, by the use of channel(s) within the walls of the receptacle, to regulate the temperature of the refractory sufficiently, such as to maintain the molten metal conveyed, contained, or filtered in/through the receptacle in a liquid state.

The invention claimed is:

1. A receptacle for handling molten metal, said receptacle comprising:

bottom and side walls comprising a refractory defining a cavity within which the molten metal is conveyed or contained; and at least one channel extending within the refractory, said channel having an inlet and an outlet, the inlet being connectable to a source for circulating a fluid within said channel, the outlet allowing said fluid to be expelled from said channel, said channel allowing, when the fluid is circulated therethrough, to regulate the temperature of the refractory and thereby of the metal conveyed or contained.

2. The receptacle according to claim 1, wherein the refractory is obtained by casting a composition of precursors into a mould and by heating said composition.

3. The receptacle according to claim 1, wherein the at least one channel comprises two channels, each extending within the refractory along a respective one of the side walls.

4. The receptacle according to claim 1, wherein the at least one channel comprises two channels, each of the two channels extending longitudinally within the refractory along a given one of the side and bottom walls.

5. The receptacle according to claim 1, comprising rods extending transversally through the at least one channel.

6. The receptacle according to claim 1, comprising a heating element located within the at least one channel.

7. The receptacle according to claim 1, wherein said at least one channel comprises several sub-channels which unite near the inlet and the outlet.

8. The receptacle according to claim 7, wherein the several sub-channels extend transversally in the refractory along the side and bottom walls.

9. The receptacle according to claim 1, comprising a first longitudinal collecting channel extending in the refractory along a first one of the side wall connected to the inlet and a second longitudinal collecting channel extending in the refractory along another one of the side walls, connected to the outlet.

10. The receptacle according to claim 1, wherein the side and bottom walls comprise at least one insulating layer.

11. The receptacle according to claim 10, wherein the at least one channel extends between the refractory and the at least one insulating layer.

12. The receptacle according to claim 1, wherein the receptacle is a launder section, the side walls comprising two opposed side walls, the two opposed side walls and the bottom wall providing the receptacle with a U-shape with two opened extremities, each side wall having an inner surface facing toward the cavity, an opposed outer surface, a top surface and opposed end surfaces at the opened extremities.

13. The receptacle according to claim 12, wherein at least one of the inlet and the outlet of the at least one channel open on one of the end surfaces for allowing connection of said at least one channel to a channel of an adjacent launder section.

14. The receptacle according to claim 12, wherein at least one of the inlet and the outlet of the at least one channel open on or near the top surface.

15. An assembly for conveying molten metal, said assembly comprising several launder sections as defined in claim 12, each channel communicating with a corresponding channel of at least one adjacent section.

16. The assembly to claim 15, comprising channel sealing elements for sealingly connecting channels of adjacent sections.

17. The receptacle according to claim 1, in combination with the source for circulating the fluid within at least one channel.

18. The receptacle in combination with the source, according to claim 17, wherein the source comprises an air blower.

19. A receptacle for holding molten metal, said receptacle comprising:

bottom and side walls comprising a refractory defining a cavity within which the molten metal is conveyed or contained; and at least one channel extending within the refractory, said channel having an inlet and an outlet, the inlet being connectable to a source for circulating a fluid within said channel, the outlet allowing said fluid to be expelled from said channel, said channel allowing, when the fluid is circulated therethrough, to regulate the temperature of the refractory and thereby of the metal conveyed or contained;

wherein the side walls of the receptacle comprise two pairs of opposed side walls, each side wall having an inner surface facing toward the cavity, and an opposed outer surface, wherein an entry is provided in one of the sidewalls for receiving molten metal, and an exit is provided in another one of the side walls, for allowing exit of the molten metal, and wherein one of the side or bottom walls is provided with a drain.

20. A receptacle for holding molten metal, said receptacle comprising:

bottom and side walls comprising a refractory defining a cavity within which the molten metal is conveyed or contained;

at least one channel extending within the refractory, said channel having an inlet and an outlet, the inlet being connectable to a source for circulating a fluid within said channel, the outlet allowing said fluid to be expelled from said channel, said channel allowing, when the fluid is circulated therethrough, to regulate the temperature of the refractory and thereby of the metal conveyed or contained; and a deflector connected to the outlet of the at least one channel, for directing the expelled fluid toward the refractory.

* * * * *